US005632827A

United States Patent [19]

Fujita et al.

[11] Patent Number: 5,632,827

[45] Date of Patent: May 27, 1997

[54] ALUMINUM ALLOY AND PROCESS FOR PRODUCING THE SAME

[75] Inventors: Hironori Fujita; Fumio Nonoyama; Atsushi Danno, all of Aichi, Japan

[73] Assignee: Kabushiki Kaisha Toyota Chuo Kenkyusho, Aichi-ken, Japan

[21] Appl. No.: 449,107

[22] Filed: May 24, 1995

[30] Foreign Application Priority Data

May 24, 1994 [JP] Japan ..... 6-135178
Apr. 3, 1995 [JP] Japan ..... 7-102948

[51] Int. Cl.[6] ..... C22C 21/00; C22C 32/00

[52] U.S. Cl. ..... 148/688; 148/648; 148/415; 148/437; 428/614; 29/DIG. 2; 72/372; 72/700

[58] Field of Search ..... 148/561, 688, 148/689, 690, 692, 693, 696, 697, 698, 403, 415, 437; 420/528, 590; 419/11, 14; 29/DIG. 2; 72/372, 700; 428/614

[56] References Cited

U.S. PATENT DOCUMENTS 5,045,278 9/1991 Das et al. ..... 148/437

5,494,541 2/1996 Fujita et al. ..... 148/561

OTHER PUBLICATIONS

The Influence of Loading Parameters on the Deformation of the A1–A4C3 System, M. Besterci, et al. Scripta Metallurgica et Materialia, vol. 29, pp. 193–197, 1993.

*Primary Examiner*—George Wyszomierski
*Attorney, Agent, or Firm*—Oblon, Spivak, McClelland, Maier & Neustadt, P.C.

[57] ABSTRACT

A aluminum alloy in the form of bulk includes an aluminum matrix and carbon particles having an average particle size of 100 nm or less and dispersed in the aluminum matrix in an amount of 1 to 40 atomic % with respect to the total atoms constituting the aluminum alloy. The aluminum alloy is produced by preparing a raw material comprising aluminum and carbon as components and forming an aluminum alloy by inserting the raw material into a cavity formed by a set of dies and applying repeatedly plastic deformation to the raw material while maintaining the temperature of the raw material in the range of from 100 to 400° C.

18 Claims, 8 Drawing Sheets

600°C HEATING

500°C HEATING

400°C HEATING

300°C HEATING

AS FORGED

STARTING MATERIAL

120 CYCLES

80 CYCLES

40 CYCLES

STARTING MATERIAL

○ Al □ C △ Ti ⊙ Al4C3 ● L12-Al3Ti
▲ DO23-Al3Ti ◬ Al3Ti

600°C HEATING

500°C HEATING

400°C HEATING

300°C HEATING

AS FORGED

STARTING MATERIAL
X-RAY INTENSITY
30
40
50
60
70
80
2θ (deg.)

ALUMINUM ALLOY AND PROCESS FOR PRODUCING THE SAME

BACKGROUND OF THE INVENTION

The present invention relates to an aluminum alloy having excellent properties such as high strength, hardness, high modulus, low thermal expansion coefficient, high heat resistance, and high wear resistance, and which is widely applicable to various industrial fields such as of automobiles, aircraft, electric appliances, and the like. The present invention also relates to a process for producing the same.

DESCRIPTION OF THE RELATED ARTS

An aluminum alloy has a high specific strength and various other excellent properties such as high strength, hardness, high thermal resistance, and high wear resistance, and is widely used in the field of automobiles, aircraft, electric appliances, etc. Particularly, it is expected to exhibit excellent performance when used in rapid moving parts. For this reason, active study has been made on the production methods such as rapid cooling and mechanical alloying.

However, the application field of the products obtained by rapid cooling or mechanical alloying is limited, because they are in the form of a powder consisting of particles from several to several tens of micrometers (μm), or a ribbon about 20 μm in thickness. Accordingly, the powder must be consolidated before using it as a component. In general, it is subjected to canning extrusion, HIP (hot isostatic pressing) process, etc., in the temperature range of from 400° to 550° C. under a non-oxidizing atmosphere. However, when subjected to such processes, the amorphous phase or the non-equilibrium phase undergoes crystallization or equilibration because of the high temperature to provide, in general, a crystallized alloy. In addition, the dispersed particles precipitated are flocculated to become coarse particles, so that the strength of particles declines. Furthermore, when a product is produced by canning extrusion effected at a low temperature, there is another problem concerning inferior strength due to insufficient bonding between the particles.

An aluminum alloy can be produced by adding a graphite powder of graphite into an aluminum melt being stirred, and casting the resulting melt thereafter. However, it is difficult to uniformly disperse the graphite powder into the melt. Moreover, because graphite particles are as large as 1 to 30 μm in diameter and because they do not bond with aluminum, they tend to undergo spalling at the boundary with the aluminum alloy. In case of forcibly stirring and mixing a powder of aluminum with a powder of graphite to effect mechanical alloying, a large part of graphite undergoes reaction with aluminum to form aluminum carbide. Thus, a large quantity of graphite, which is effective as a lubricant, is lost from the resulting material. Furthermore, in case of consolidation of the mixed powder into a bulk material, it requires canning extrusion and the like to be performed in a temperature range of from 400° to 550° C. The remaining graphite then changes into relatively large aluminum carbide crystals which impair the strength of the resulting alloy. Moreover, age-hardening by the precipitation of aluminum carbide is not expected to occur on the alloy. This is another disadvantage of this process.

It can be seen from the foregoing that a material obtained by conventional processes such as rapid cooling or mechanical alloying comprises a non-equilibrium phase, etc., and it results in the form of a powder or a ribbon. Accordingly, a serious problem of processing the material into a shaped product by means of canning extrusion and the like must be overcome. Thus, it is strongly demanded to develop an economical and easy process for producing an aluminum alloy, which enables a bulk material containing a non-equilibrium phase and the like having superior properties such as high strength, hardness, high elastic modulus, low thermal expansion coefficient, high heat resistance, and high wear resistance.

SUMMARY OF THE INVENTION

An object of the present invention is to provide an aluminum alloy in the form of bulk suitable for use in various industrial fields inclusive of automobiles, aircraft, and electric appliances, the aluminum alloy having superior properties such as high strength, hardness, high modulus, low thermal expansion coefficient, high heat resistance, and high wear resistance.

Another object of the present invention is to provide a process for producing an aluminum alloy in the form of bulk having the aforementioned superior properties.

The present inventors studied the problems in detail to achieve the objects above. The present invention is accomplished based on the following findings.

A powder compact of a mixture obtained by mixing powders of pure aluminum, carbon, and titanium was subjected repeatedly to a strong plastic deformation process by using a processing means whose direction of processing can be varied as shown in FIG. 1, and strained to a degree far greater than a one which results by a conventional plastic deformation. The inventors discovered at this experiment that the resulting material comprises structures of a non-equilibrium phase inclusive of a super-saturated solid solution phase and others, with carbon particles having a size in the order of nanometers (nm) being finely dispersed therein, and that a bulk material is obtainable by strongly applying the plastic deformation alone. Furthermore, it has been found that a material with a non-equilibrium phase consisting mainly of compounds finely dispersed therein, can be obtained by heating the bulk material to a temperature range of from 300° to 600° C. The material obtained has a tensile strength of 70 kgf/mm$^2$ or higher, an elastic modulus of 130 GPa or higher, and a thermal expansion coefficient of $15\times10^{-6}$/K or lower.

Throughout the specification, a bulk material represents a lump of material originally made of powders or particles, said powders or particles being strongly bound to each other as in sintering or melting. The bulk material usually measures mm order or more.

In accordance with a first aspect of the present invention, there is provided an aluminum alloy comprising an aluminum matrix and carbon particles having an average particle size of 100 nm or less, said carbon particles being dispersed in said matrix in an amount of 1 to 40 atomic % with respect to the total atoms constituting the aluminum alloy, said aluminum alloy being in the form of bulk.

The aluminum alloy according to the first aspect of the present invention preferably comprises aluminum and carbon added therein in a quantity of from 1 to 40% by atomic. If carbon should account for 1% by atomic or less, only small effect would be exerted on producing a high strength material improved in wear resistance. An addition of carbon in a quantity of 40% by atomic or higher embrittles the resulting material. Accordingly, carbon content falling out of the specified range is not preferred. The carbon particles that are dispersed in the aluminum matrix are preferably 100 nm or less in average diameter. If carbon particles should be larger than 100 nm in average diameter, the strength and the heat resistance of the material would be impaired. From the viewpoint of achieving an aluminum alloy having high strength, hardness, high elastic modulus, low thermal expansion coefficient, high thermal resistance, and high wear resistance, particularly preferred are the carbon particles whose size range from several to several tens of nanometers in diameter. The aluminum alloy according to the first aspect of the present invention exhibits superior characteristics such as high strength, hardness, high elastic modulus, low thermal expansion coefficient, high thermal resistance, and high wear resistance because carbon particles 100 nm or less in average diameter are finely dispersed in the matrix. Particularly, when graphite is used as carbon, a material having a low friction coefficient is obtained because graphite functions as a lubricant.

In accordance with a second aspect of the present invention, there is provided an aluminum alloy further comprising crystals of a super-saturated solid solution phase and/or a non-equilibrium phase having an average crystal size of 100 nm or less, said crystals being formed from a reaction between aluminum and at least one metal or non-metal selected from the group consisting of elements of Groups 4a, 5a, 6a, 7a, 8a of the periodic table, silicon and boron, dispersed in said matrix in an amount of 0.5 to 20 atomic % with respect to the total atoms constituting the aluminum alloy.

The aluminum alloy according to the second aspect of the present invention preferably contains aluminum, from 1 to 40% by atomic of carbon, and from 0.5 to 20% by atomic of at least one metal or non-metal selected. The content of carbon is limited to the range above because of the reason described above for the case of the aluminum alloy according to the first aspect of the invention. If metals and non-metals other than carbon should account for 0.5% atomic or less, they would have no effect in reinforcing the material, whereas an addition thereof in a content of 20% by atomic or more impairs the toughness of the material. Accordingly, a composition falling out of the specified range is not preferred.

The average diameter of the carbon particles that are dispersed in the matrix of the aluminum alloy is limited by the same reason described above for the first aspect of the present invention. The average diameter of the super-saturated solid solution phase and/or the non-equilibrium phase of a compound and the like is limited to 100 nm or less because crystals of over 100 nm in average diameter would no longer be effective as dispersed crystals. In particular, crystals from several to several tens of nanometers are preferred from the viewpoint of improving the strength, because they have strong effect on suppressing slip dislocations. Furthermore, the super-saturated solid solution phase and/or the non-equilibrium phase may contain therein carbon to form a solid solution. The characteristics of the resulting alloy such as strength can be further improved by adding carbon to form a solid solution.

The aluminum alloy according to the second aspect of the present invention exhibits superior characteristics such as high strength, hardness, high elastic modulus, low thermal expansion coefficient, high thermal resistance, and high wear resistance because carbon particles and crystals of a super-saturated solid solution phase and/or a non-equilibrium phase generated through the reaction of aluminum and the alloy element, which are 100 nm or less in average diameter, are finely dispersed in the matrix. Particularly, when graphite is used as carbon, a material having a low friction coefficient results because graphite functions as a lubricant.

In accordance with a third aspect of the present invention, there is provided an aluminum alloy wherein said carbon particles comprise crystals of a non-equilibrium phase and/or an equilibrium phase mainly composed of aluminum carbide and having an average crystal size of 100 nm or less. The aluminum alloy according to the third aspect of the present invention contains crystals of aluminum carbide finely dispersed in its matrix suppress slip dislocations, and exhibits superior characteristics such as high strength, hardness, high elastic modulus, low thermal expansion coefficient, high thermal resistance, and high wear resistance.

In accordance with a fourth aspect of the present invention, there is provided an aluminum alloy further comprising crystals of a non-equilibrium phase and/or an equilibrium phase having an average crystal size of 100 nm or less, said crystals being formed from a reaction between aluminum and at least one metal or non-metal selected from the group consisting of elements of Groups 4a, 5a, 6a, 7a, 8a of the periodic table, silicon and boron dispersed in said matrix in an amount of 0.5 to 20 atomic % with respect to the total atoms constituting the aluminum alloy.

The aluminum alloy according to the fourth aspect of the present invention exhibits superior characteristics such as high strength, hardness, high elastic modulus, low thermal expansion coefficient, and high thermal resistance, because it contains crystals of a non-equilibrium phase and/or an equilibrium phase finely dispersed in the matrix thereof.

In accordance with a fifth aspect of the present invention, there is provided a process for producing an aluminum alloy, comprising the steps of preparing a raw material comprising aluminum and carbon as components, and forming an aluminum alloy in the form of bulk by inserting the raw material into a cavity formed by a set of dies and applying repeatedly plastic deformation to the raw material with the set of dies while maintaining the temperature of the raw material in the range of from 100° to 400° C., the resulting aluminum alloy comprising an aluminum matrix and carbon particles with an average particle size of 100 nm or less dispersed in the aluminum matrix.

The process for producing an aluminum alloy according to the fifth aspect of the present invention is characterized in that a bulk material having a shape similar to that of the final product is obtained by applying repeated plastic deformation alone to finely disperse carbon in the matrix. The reason why an aluminum matrix containing carbon particles finely dispersed therein is obtainable is assumed as follows.

In case a shaped powder compact obtained from powders of aluminum and carbon is subjected to repeated plastic deformation, for instance, the particles of aluminum powder form a bond to each other through diffusion, but the particles of aluminum do not undergo bonding to those of carbon. Accordingly, carbon particles tend to be enclosed in the aluminum matrix. Thus, when the carbon particles enclosed in the matrix are subjected to plastic deformation, they undergo size-reduction to form unusually fine particles 100 nm or less in average diameter. In particular, when processing is applied in such a manner as changing the direction of each processing, friction and crushing can be more easily applied to the powder. Otherwise, the processing can be repeated in one direction only.

The process according to the fifth aspect of the present invention provides a bulk material by effecting it in a temperature range of from 100° to 400° C. In the present process, high energy is applied to finely divide carbon by friction and crushing, and the metallic powder particles are strongly bonded to each other by applying high pressure and by taking advantage of the activated surface. The bonding of the metallic powder particles to each other occurs assumably by the diffusion of aluminum among the powder particles. The diffusion rate can be increased most advantageously by elevating the process temperature. Moreover, from the viewpoint of minimizing the deformation resistance, the process is preferably effected at a higher temperature. However, too high a temperature accelerates the formation of an equilibrium phase such as aluminum carbide due to the diffusion reaction among the powder particles. Accordingly, the process is preferably effected in a temperature range of from 100° to 400° C.

The process for producing an aluminum alloy in the form of bulk according to the fifth aspect of the present invention provides a material comprising an aluminum matrix finely dispersed therein carbon particles of 100 nm or less in average diameter by a relatively simple process of repeatedly applying plastic deformation to a powder compact. Thus, a material which exhibits superior characteristics such as high strength, hardness, high elastic modulus, low thermal expansion coefficient, high thermal resistance, high wear resistance and low friction coefficient can be realized. Furthermore, because the final product is obtained in the form of bulk and not in the form of a powder or a ribbon, the process excludes danger which is found in the conventional process using a powder or saves a consolidation step of powders. Moreover, in case graphite is used as carbon, seizure of aluminum in the forging dies can be considerably reduced. Accordingly, the process load can be reduced, and the processed product can be more easily dismounted from the dies.

In accordance with a sixth aspect of the present invention, there is provided a process for producing an aluminum alloy, wherein said raw material further comprises at least one member selected from the group consisting of elements of Groups 4a, 5a, 6a, 7a, 8a of the periodic table, silicon and boron as components, and said resulting aluminum alloy in the forming step further comprises crystals of a super-saturated solid solution phase and/or a non-equilibrium phase with an average crystal size of 100 nm or less, said crystals being formed from said aluminum and said at least one member.

The process including repeated plastic deformation according to the sixth aspect of the present invention is characterized in that finely dispersed carbon particles and crystals of a super-saturated phase and/or a non-equilibrium phase can be formed in the aluminum matrix by applying repeated plastic deformation alone. Furthermore, the process provides a shaped material easily applied to the final product. As described above, the fine dispersion of carbon and the formation of a non-equilibrium phase are realized by producing a material mainly composed of aluminum, carbon, and at least one metal or non-metal selected from the group consisting of elements of Groups 4a, 5a, 6a, 7a, 8a, silicon, and boron and inserting the material into a set of dies while maintaining the gas atmosphere to be inert and the temperature in a range of from 100° to 400° C. The structure comprising the finely dispersed carbon is obtained by a similar effect described above in the first aspect of the present invention. The reason for the formation of a non-equilibrium phase is assumed as follows.

The process for producing an aluminum alloy according to the sixth aspect of the present invention comprises forming super-fine carbon particles and crystals of a non-equilibrium phase having an average diameter of several tens of nanometers or less, by taking advantage of the solid phase reaction phenomena similar to that employed in the conventional process of mechanical alloying. However, the process according to the present invention differs from the conventional ones in the following points. Mechanical alloying process uses a ball mill to effect milling for a duration of from 10 to 1,000 hours at a temperature in the vicinity of the room temperature. In this manner, powder particles are subjected to repeated friction, crushing, and aggregation to form an intergranular non-equilibrium phase. However, in this process, a powder is obtained unexceptionably as the final product. The resulting powder is active, but the surface activity is lost due to the slight absorption of atmospheric gas or to the formation of a compound which occurs on the surface of the powder, or because of the long passage of time after the formation of the active surface. Accordingly, in case of consolidation of the powder sample, the powder must be taken out from the ball mill, placed inside a vessel, and subjected to canning extrusion or HIP process at a high temperature in a range of form 450° to 600° C.

In contrast to the conventional process, the process according to the sixth aspect of the present invention comprises producing a bulk material in a temperature range of from 100° to 400° C. by repeatedly applying high energy to effect plastic deformation. Accordingly, carbon particles are finely divided by the friction and crushing applied thereto, and a non-equilibrium phase is formed by allowing diffusion reaction to occur among the powder particles, while tightly bonding the metallic particles to each other by applying high pressure thereto and by taking advantage of the effect of the activated surface. The friction among the powder particles and crushing more readily occur on the particles by changing the direction of each processing. Otherwise, processing may be effected in one direction. The effect of carbon on the formation of a non-equilibrium phase in case of using an aluminum powder, a carbon powder, and a titanium powder, for instance, is the same as that of the case using aluminum powder with carbon powder. However, in case of aluminum powder and titanium powder, the surface of each powder particle is activated by the friction and crushing that are exerted by the strong plastic deformation processing. Hence, diffusion is found to occur more readily among the aluminum and titanium powder particles. In the next step of the process, the formation of an active surface proceeds by applying further friction and crushing to the powder particles. By repeatedly applying the plastic deformation process, bonding of aluminum to titanium occurs in the material by diffusion as to form a non-equilibrium phase. In case titanium is incorporated in a large quantity, carbon is found to be finely dispersed in the non-equilibrium matrix. In other words, a structure comprising a non-equilibrium phase with carbon particles finely dispersed therein at a size in the order of nanometers. In case the quantity of titanium is small, on the other hand, a structure comprising carbon particles finely dispersed in the aluminum matrix is obtained.

A super-fine dispersion and a non-equilibrium phase are assumed to be formed by the diffusion which occurs among the powder particles and the like under the application of a high energy. The diffusion rate can be increased most advantageously by elevating the process temperature. Moreover, from the viewpoint of minimizing the deformation resistance, the process is preferably effected at a higher temperature. However, too high a temperature accelerates the formation of an equilibrium phase such as aluminum carbide due to the diffusion reaction among the powder particles. In addition, even though once a non-equilibrium phase is formed, it turns into an equilibrium phase because the high temperature is maintained. Accordingly, the process is preferably effected in a temperature range of from 100° to 400° C.

In case a cast article is used as the starting material, the repeated plastic deformation process is applied to a stable phase dispersed in the aluminum-alloy cast article in the form of relatively large carbon particles or intermetallic compounds. Thus, while carbon is reduced to fine particles by crushing, friction and crushing are repeatedly applied to each of the stable phases to obtain a structure with a non-equilibrium phase and a super-saturated solid solution phase finely dispersed therein.

The process for producing an aluminum alloy according to the sixth aspect of the present invention provides, by a relatively simple process of repeatedly applying plastic deformation to a powder compact, a material comprising an aluminum matrix with carbon particles of 100 nm or less in average diameter and crystals of a super-saturated phase and/or a non-equilibrium phase finely dispersed therein. Thus, a material which exhibits superior characteristics such as high strength, hardness, high elastic modulus, low thermal expansion coefficient, high thermal resistance, high wear resistance and low friction coefficient can be realized. Furthermore, because the final product is obtained in the form of bulk and not in the form of a powder or a ribbon, the process excludes danger which is found in the conventional process using a powder or saves a consolidation step of powders.

Moreover, in case graphite is used as carbon, seizure of aluminum in the forging dies can be considerably reduced. Accordingly, the process load can be reduced, and the processed product can be more easily dismounted from the dies.

The set of dies in the forming step may comprise one of the following:

(1) a plurality of trapezoidal punches disposed in the upper, lower, left and right positions to form a cavity surrounded by front portions thereof by contacting each of said punches on side walls thereof;

(2) a die having a cylinder therein and a pair of punches inserted into the cylinder, a cavity being formed in the cylinder and having an orifice with a small cross sectional area; and (3) a die having a concave portion thereon and a punch opposing to the concave portion, a cavity being formed between the concave portion and the punch.

In accordance with a seventh aspect of the present invention, there is provided a process for producing an aluminum alloy, further comprising a conversion step for forming a structure with a non-equilibrium phase and/or an equilibrium phase mainly composed of a compound with aluminum dispersed in said aluminum matrix by heat treating said resulting aluminum alloy in a temperature range of from 300° to 600° C.

The process for producing an aluminum alloy according to the seventh aspect of the present invention is characterized in that a material is subjected to repeated plastic deformation to obtain a material comprising dispersed therein super-fine particles of carbon and crystals of a non-equilibrium phase, and in that the resulting material is subjected to heat treatment to newly obtain a material finely dispersed therein a non-equilibrium phase and/or an equilibrium phase. Thus is obtained a material having superior characteristics such as high strength, hardness, high elastic modulus, low thermal expansion coefficient, high thermal resistance, high wear resistance, and low friction coefficient.

The reason why an aluminum alloy having superior characteristics such as high strength is obtainable by the heat treatment above is assumed as follows. By heattreating the aluminum alloy comprising the non-equilibrium phase above at a temperature range of from 300° to 600° C., an alloy element diffused out from the super-saturated solid solution and the like in the aluminum alloy matrix or an active element finely size-reduced to the order of nanometers form a structure comprising finely dispersed therein a non-equilibrium phase or an equilibrium phase mainly composed of a compound with aluminum. Thus, strength and other characteristics can be improved. Moreover, the strength remains without being impaired even in a temperature region as high as in a range of from 300° to 600° C.

According to a process for producing an aluminum alloy of the seventh aspect of the present invention, there is provided a relatively simple process which comprises shaping relatively easily a material which is relatively soft before heat-treating into the shape of a final product, and heat-treating the shaped material to obtain a high strength aluminum alloy material comprising finely dispersed therein a non-equilibrium phase and/or an equilibrium phase mainly composed of a high strength compound.

DETAILED DESCRIPTION OF THE INVENTION

Figure 1A:
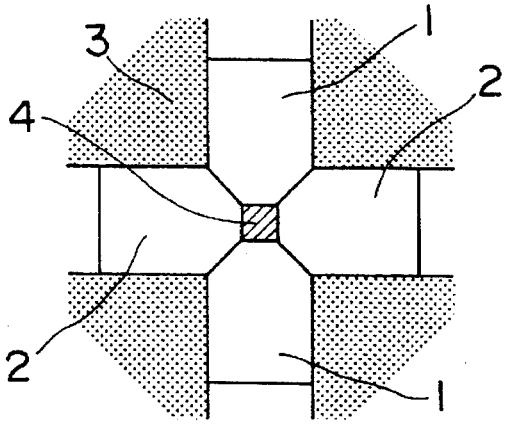
FIGS. 1A, 1B, and 1C are diagrams showing process steps for effecting repeated processing (cross-shaped compression method)

The present invention is described in further detail for each of the aluminum alloys and the processes for producing the same, by referring to each of the first to the seventh aspect of the present invention above.

In the detailed description below, the elements to be mixed in the powder of aluminum, etc., which constitutes the material to be processed, include carbon in fine particles as an essential one. There is no particular restriction concerning the type of carbon to be used in the present invention, and commonly used graphite and amorphous carbon can be employed. Furthermore, an element which readily forms a non-equilibrium phase such as a supersaturated solid solution or an intermetallic compound must be added to the powder system. Preferably, when the material is subjected to the final step of heat treatment, this element allows a non-equilibrium phase or a stable phase based on a metallic compound to precipitate as a fine dispersion in the aluminum alloy matrix. Moreover, the element preferably remains without being aggregated even at high temperatures, and enables the formation of fine particle precipitates. Preferred from these points of view is at least one metal or non-metal selected from the group consisting of elements of Groups 4a, 5a, 6a, 7a, 8a, silicon, and boron.

The amount of carbon to be added is preferably in a range of from 1 to 40% by atomic. If carbon is added in an amount of 1% by atomic or less, only small effect would be exerted on producing a high strength material improved in wear resistance. An addition of carbon in an amount of 40% by atomic or higher embrittles the resulting material. The metals or non-metals other than carbon is preferably added at an amount of from 0.5 to 20% by atomic. If metals and non-metals other than carbon should account for 0.5% atomic or less, they would have no effect in reinforcing the material, whereas an addition thereof at a content of 20% by atomic or more impairs the toughness of the material.

There is no particular restriction concerning the morphology of the material to be processed. More specifically, for example, a mixed powder comprising aluminum and carbon; a mixed powder comprising aluminum, carbon, and at least one element selected from the group consisting of elements of Groups 4a, 5a, 6a, 7a, 8a, silicon, and boron; and a powder compact or a cast article obtained from the mixed powders above; can be used without any problem.

Specifically in the present invention, carbon particles and non-equilibrium phases and the like dispersed in the matrix of aluminum and the like are preferably 100 nm or less in size. From the viewpoint of increasing the strength of the bulk material, more preferably, they are from several to several tens of nanometers in size. Finely dispersed carbon particles and non-equilibrium phase can be formed by: (A) repeatedly applying plastic deformation for the crushing, the formation of new surfaces, and the diffusion of elements of the aluminum powder, the powder of an additive element, and the various types of phases present in the aluminum alloy; and (B) heating the material at a temperature not lower than 100° C. but not higher than the temperature at which an equilibrium phase is formed, i.e., 400° C., thereby facilitating the plastic deformation and diffusion. The process can be performed at a temperature falling out of the range defined above, however, at an expense of low diffusion rate.

Plastic deformation must be applied regardless of what type of material is used, for example, in case of using a mixed powder of the starting elements, a powder compact obtained by compressing the thus obtained mixed powder, or a cast article of an aluminum alloy obtained by melting process and the like and containing dispersed therein a stable phase. By applying plastic deformation, each of the phases is subjected to repeated friction and crushing with each other to obtain an activated interface. Furthermore, a sufficiently high draft and load must be applied to bond the particles by diffusion. Under such an intense plastic deformation, diffusion and consolidation occur at a part of the surface brought into contact with each other to confine carbon and the like to a limited area. To newly subject the thus enclosed carbon and the like to crushing in the subsequent process step, and to thereby form an activated surface, the plastic deformation is repeated at least several tens of cycles. The processing stress is applied at least equivalent to the yield strength of the aluminum alloy, i.e., at 20 kg/mm$^2$ or higher. Preferably, by taking the friction which occurs on the sliding plane of the mold and the damage of the mold into consideration, the processing is effected under a stress of from 60 to 200 kg/mm$^2$.

Repeated plastic deformation processing can be effected, for example, by methods described below:

(1) Cross-shaped compression

Figure 2A:
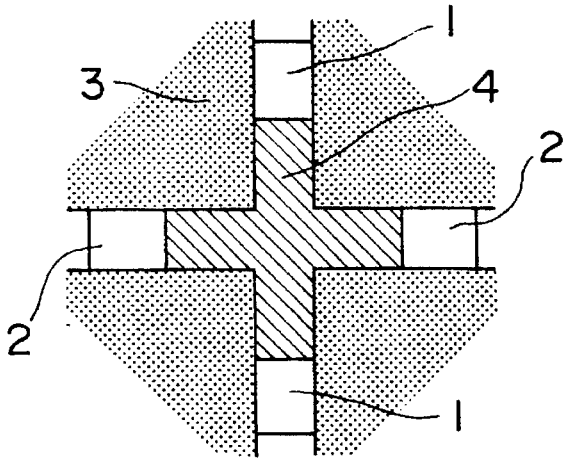
FIGS. 2A, 2B, and 2C are diagrams showing other process steps for effecting repeated processing (closed cross-shaped compression method)
Figure 2B:
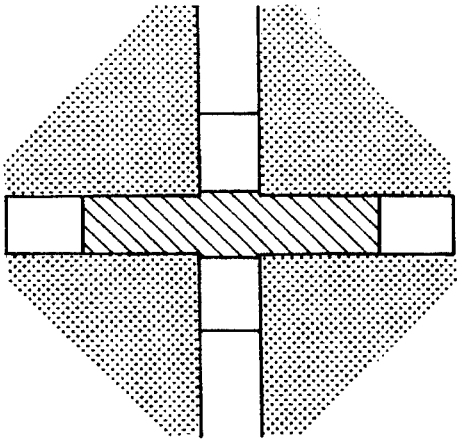
Figure 2C:
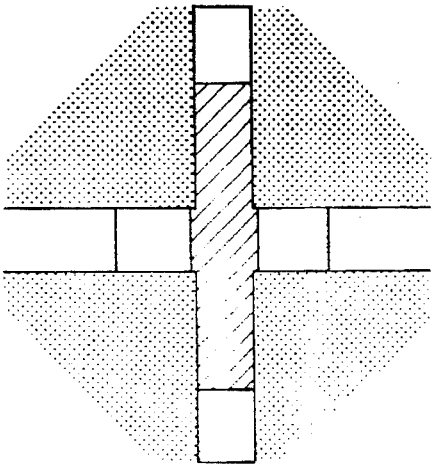

This method employs a set of dies with movable punches arranged in the perpendicular and the horizontal directions equipped in a processing machine commonly employed in pressing and the like. More specifically, the material to be processed is placed in the center portion, and is compressed by a punch 1 from the direction A. The material is compressed, but because a punch 2 is provided movable, a part of the material is extruded in the direction perpendicular to the direction in which the load is applied. Then, by operating the punch 2, the material is compressed by applying a load from the direction B. Processing proceeds in this manner by repeating this operation sequence. It can be seen that one of the punches directly drives the other. Accordingly, the sample can be greatly deformed. A disadvantage of this method is that the material to be processed may be subject to cracking as the volume of the cavity in the dies changes. This disadvantage can be overcome by using an equipment of a closed type, as shown in FIGS. 2A to 2C, which keeps the volume of the cavity almost constant. In the latter case, it is desirable to provide a mechanism which interlinks the advancing punches with the retreating punches.

Figure 3:
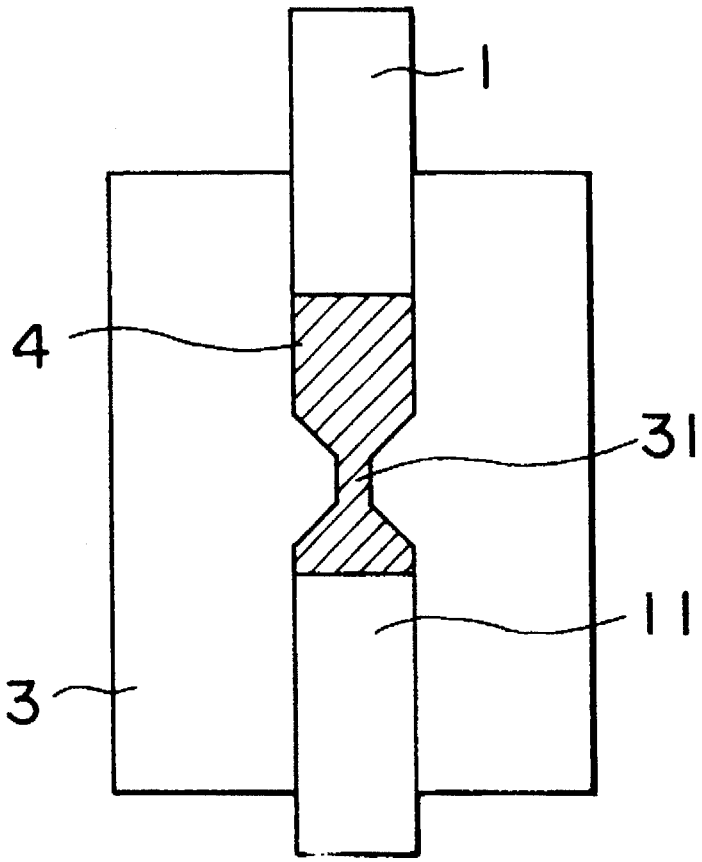
FIG. 3 is a diagram showing a process step for effecting repeated processing (extrusion method)

(2) Extrusion:

This method employs a die as shown in FIG. 3. The material to be processed is placed between the two punches. As the punches reciprocate, the material to be processed is forced through the narrow orifice 31 up and down. When the upper punch 1 moves downward under load, the lower punch 11 also moves downward while keeping the confined volume of the cavity. Thus, the extruded material has its cross-sectional area expanded as large as that of a punch. This method permits effective plastic deformation without causing no cracking to the material to be processed, owing to the closed extrusion which keeps the volume of the cavity almost constant.

(3) Rotary forging:

This method employs a device consisting of a stationary die and a punch placed above. The material to be processed is placed at the center of the die, and undergoes plastic deformation when a local pressing is applied by rotating and vibrating the upper punch. Deformation per cycle is relatively small, but repeated plastic deformation can be easily applied. Moreover, materials of large size can be processed by this method because processing load can be minimized.

In addition to the fulfillment of the conditions (A) and (B) above, in case a powder material is used as the material to be processed, the process is preferably effected under an inert gas atmosphere to maintain the surface of aluminum and the like clean. Under an inert gas atmosphere, diffusion between aluminum and the surface of various other phases can be favorably effected. Even when the powder are crushed to form new active surfaces by plastic deformation, surface activity would be lost if oxidation or nitridation occurs due to the atmospheric gas. Accordingly, to maintain the activity of the newly formed surface, the process is effected under high vacuum or in an inert gas atmosphere such as of argon.

The present invention is described in further detail below referring to preferred embodiments.

EXAMPLE 1

Figure 1B:
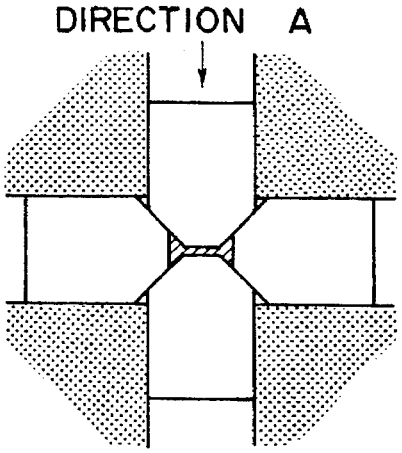
Figure 1C:
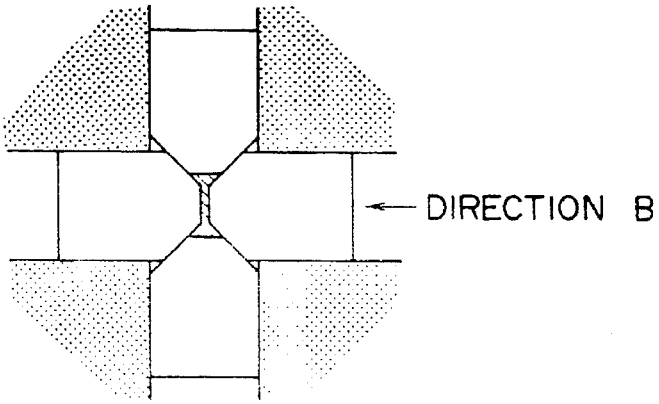

A pure aluminum powder passed through a 350-mesh sieve and a powder of pure graphite composed of particles about 1 μm in average diameter were mixed in the atomic ratio of 80:20, and after sufficiently mixing the mixed powder, a powder compact 20×10×8.5 $mm^3$ (length×width×height) in size was obtained therefrom by using a hydraulic press operated at a pressure of about 1,000 $kgf/cm^2$. The powder compact weighed 3.7 g. The resulting sample was placed and set in the center of the set of dies, and heated to 300° C. by setting the dies in an electric furnace while flowing argon gas at a flow rate of from 1 to 3 l/min to prevent oxidation. Then, after taking the entire dies out of the electric furnace, the dies were set in a pressing machine equipped with a mechanism which applies pressures from the upper and the lower side of the dies, and pressure was applied from the direction A shown in FIG. 1B to compress the powder compact therein to a thickness of 2 mm. By the compression operation, a part of the sample was found to be extruded in the direction perpendicular to the direction A. Then, the dies were rotated by an angle of 90° to apply pressure thereto from direction B as shown in FIG. 1C until the sample was compressed to a thickness of 2 mm. This sequential operation was repeated for 120 cycles. The maximum compression load in the initial stage of the process was about 15 ton, but it was found to increase up to 20 ton after performing the operation for 120 cycles.

The dies were disintegrated to take the sample out from the dies. A slight crack was found to generate on the part of surface of the thus obtained sample, but the powder particles were found to be tightly bonded with each other to provide a material bulk. On observing the cross section of the sample under a microscope, no cracks nor inclusions and the like was observed.

Figures 4A, 4B, 4C, 4D, 4E, 4F:
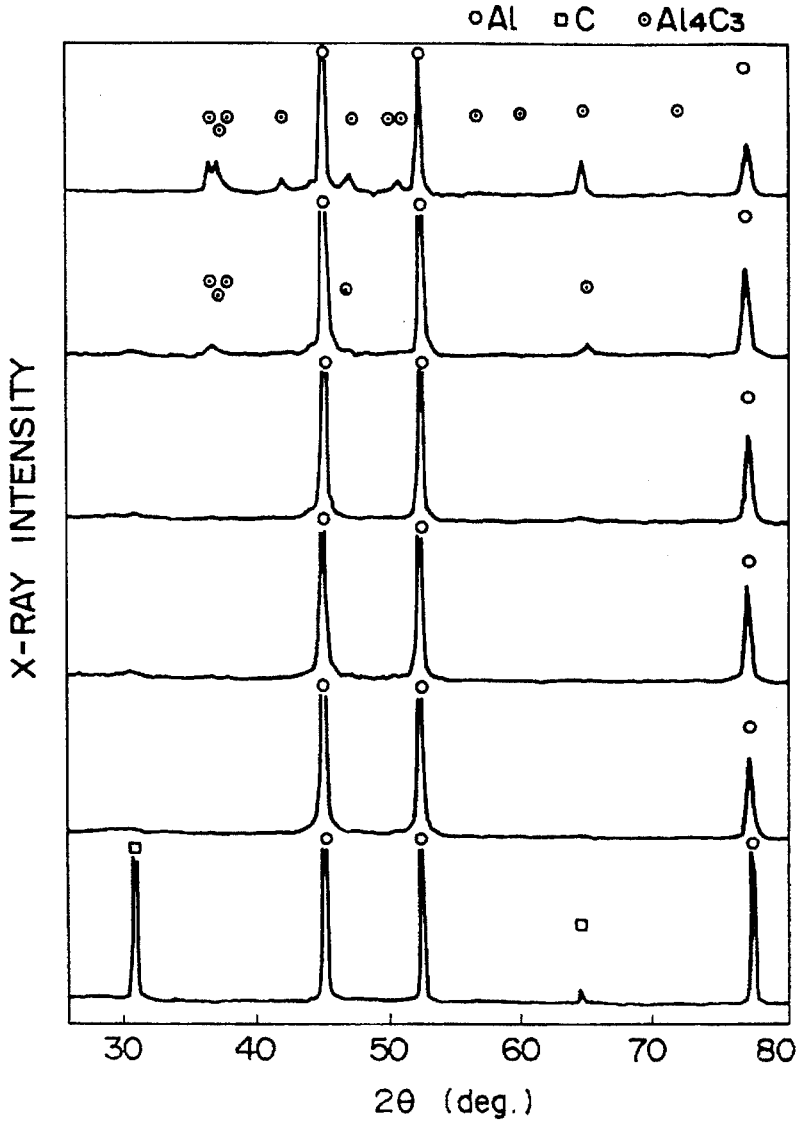
FIGS. 4A, 4B, 4C, 4D, 4E, and 4F are graphs showing the results of X-ray diffraction performed on a starting material, a forged sample subjected to repeated processing (cross-shaped compression method) in Example 1, and samples each maintained at a temperature of 300° C., 400° C., 500° C., and 600° C.

The sample was subjected to X-ray diffraction to obtain a pattern as shown in FIG. 4B. FIG. 4A shows the presence of graphite in the starting material, but graphite is no longer identified in the resulting product as shown in FIG. 4B. Under transmission microscope, graphite particles from 5 to 10 nm in average diameter were found to be dispersed in the aluminum matrix. By analyzing the results, it was found that the sample contained fine graphite particles unidentifiable by X-ray diffraction. Considering conventional casting processes in which graphite is incorporated in an aluminum matrix as particles about 1 to 20 μm in diameter, the present example enables extremely fine graphite particles from 5 to 10 nm in average diameter.

Figures 5A, 5B, 5C, 5D:
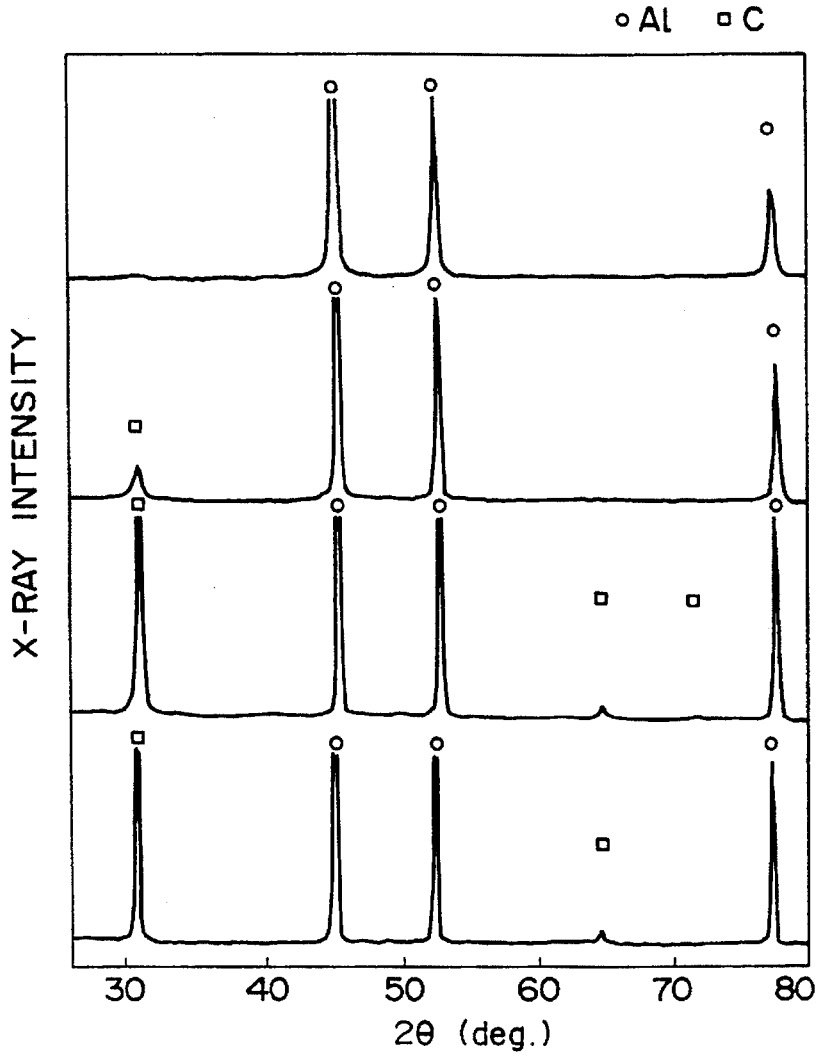
FIGS. 5A, 5B, 5C, and 5D are graphs showing the results of X-ray diffraction performed on a starting material and samples subjected to repeated processing (cross-shaped compression method) in Example 1 for different repetition cycles of processing.

FIGS. 5A to 5D show the influence of repeated processing on the diameter of graphite. The starting material used for the experiment shown in FIG. 5A comprises graphite particles about 1 μm in diameter. FIG. 5B shows the change on the X-ray diffraction pattern on increasing the repetition cycles. It can be seen that there is no distinguished change in the X-ray pattern after 40 cycles of plastic deformation processing, but by analyzing the broadening of the diffraction pattern, the average diameter of the particles of graphite was found to be about several tens of nanometers. After repeating processing for 80 cycles, as shown in FIG. 5C, the graphite particles were found to be 12 nm in diameter. As shown in FIG. 5D, after repeating processing for 120 cycles, size reduction of the graphite particles proceeded rapidly as to yield particles having an average diameter of several nanometers. A part of the powder compact subjected to compression was heat-treated (aging treatment) for 1 hour in argon gas flow while maintaining the temperature at 300° C., 400° C., 500° C., and 600° C. The X-ray diffraction patterns of each of the samples are given in FIGS. 4C, 4D, 4E, and 4F, and the results obtained by measuring Vicker's hardness (Hv) at room temperature are given in FIG. 6.

The sample subjected to repeated processing yields a structure comprising finely dispersed graphite particles as shown in FIG. 4B. The hardness of the sample was found to be Hv 100. However, by subjecting the sample to aging treatment, an aluminum carbide ($Al_4C_3$)-like phase was found to develop at about 500° C., which converts into an equilibrium phase $Al_4C_3$ in the vicinity of a higher temperature of 600° C. At the same time, a maximum hardness of Hv 220 was obtained. The age hardening characteristics can be observed not only on graphite, but also on amorphous carbon.

As described in the foregoing, the process for producing an aluminum alloy according to the present invention comprises repeatedly processing the material, and it provides a super-fine structure of graphite, which has been hardly achieved by a conventional process. Furthermore, a bulk material further improved in hardness can be obtained by subjecting the material to aging treatment.

EXAMPLE 2

A pure aluminum powder passed through a 350-mesh sieve and a powder of pure graphite composed of particles about 1 μm in average diameter were mixed in the atomic ratio of 95:5, and after sufficiently mixing the mixed powder, the sample was subjected to repeated processing for 120 cycles in a set of dies whose temperature was set at 300° C. in the same manner as in Example 1 to obtain a powder compact of 2 mm in thickness. A slight crack was found to generate on the surface of the thus obtained sample, but the powder particles were found to be tightly bonded with each other to provide a bulk material.

The sample was subjected to X-ray diffraction to obtain a pattern similar to that of FIG. 4B, from which graphite cannot be identified. Thus, the aluminum alloy sample was found to be an alloy containing dispersed therein super-fine graphite particles 10 nm or less in average diameter.

EXAMPLE 3

A pure aluminum powder passed through a 350-mesh sieve and a powder of pure graphite composed of particles about 1 μm in average diameter were mixed in the atomic ratio of 60:40, and after sufficiently mixing the mixed powder, the sample was subjected to repeated processing for 120 cycles in a set of dies whose temperature was set at 300° C. in the same manner as in Example 1 to obtain a powder compact of 2 mm in thickness.

The sample thus obtained was subjected to X-ray diffraction to obtain a pattern comprising peaks assigned to graphite and broad ones for graphite. The diameter of the crystals determined from the broadening of the X-ray diffraction pattern was about 15 nm. $Al_4Cl_3$ was found to precipitate by heating the sample to 600° C.

EXAMPLE 4

A mixed powder containing 10 atomic % each of graphite and titanium with respect to aluminum was mixed, and was subjected to compression processing. Aluminum and graphite powders were the same type as those used in Example 1. Titanium was in the form of powder passed through a 350-mesh sieve. The mixed powder sample was placed inside a set of dies shown in FIGS. 1A to 1C, and was maintained at a temperature of 300° C. in the same manner as in Example 1, while repeatedly applying compression deformation to the sample for 120 cycles. The sample thus obtained from the disintegrated dies was found to be in the form of bulk having no cracks and powder particles sufficiently bonded to each other.

Figure 6:
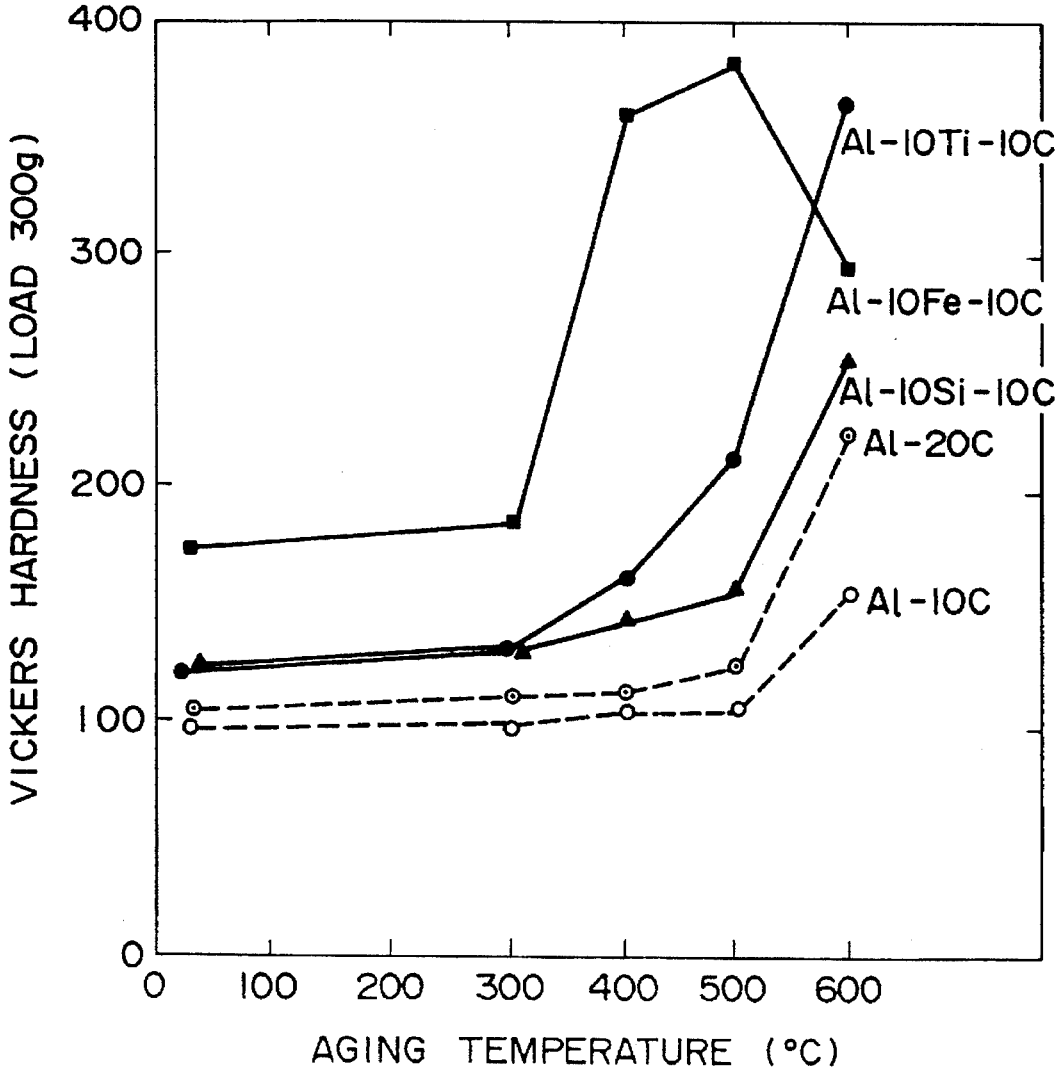
FIG. 6 is a graph showing the relation between the temperature and the hardness (Hv) of the samples subjected to repeated processing (cross-shaped compression method) in Examples 1, 4, 6, etc.
Figures 7A, 7B, 7C, 7D, 7E, 7F:
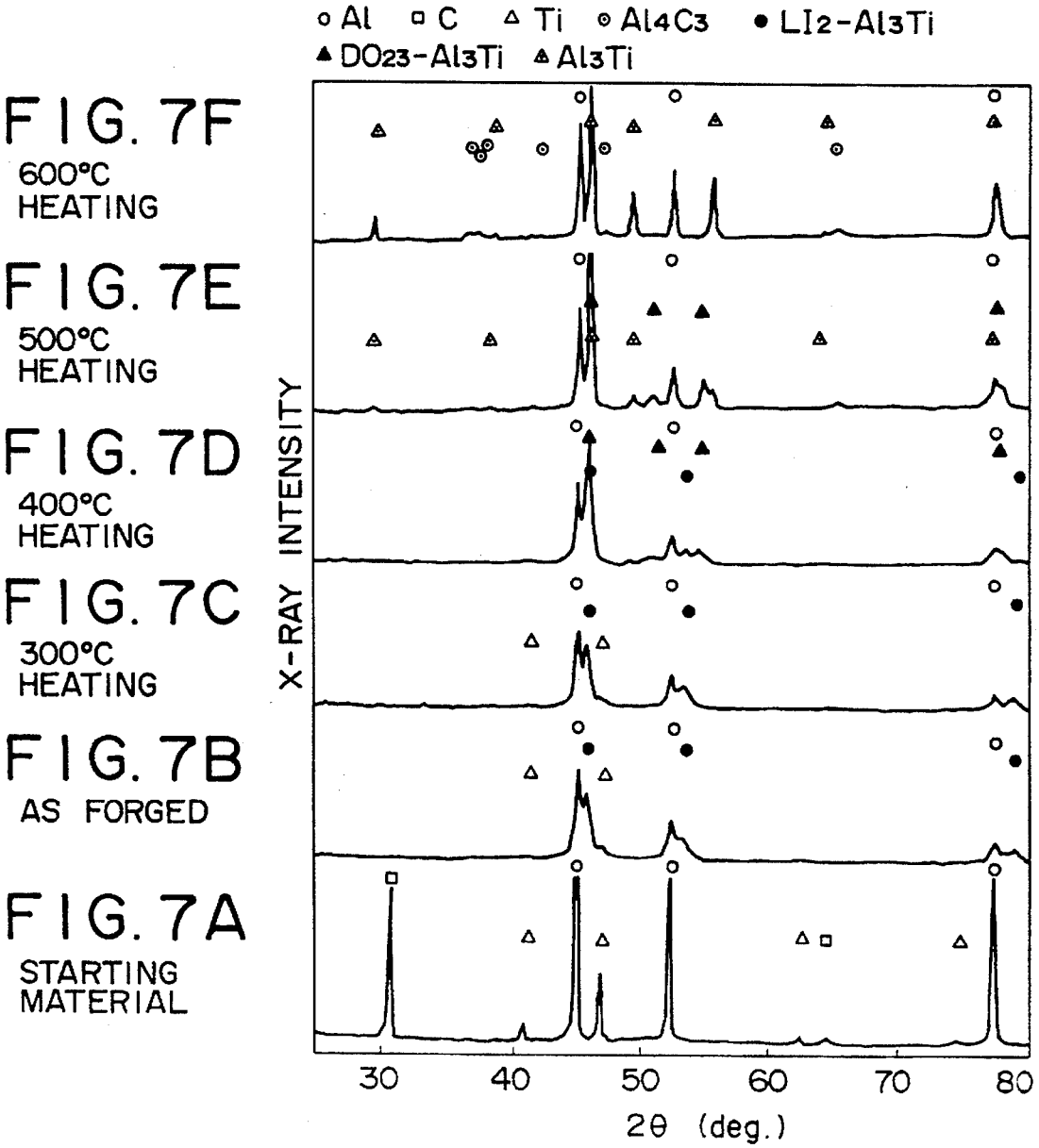
FIGS. 7A, 7B, 7C, 7D, 7E, and 7F are graphs showing the results of X-ray diffraction performed on a starting material, a forged sample subjected to repeated processing (cross-shaped compression method) in Example 4, and samples each maintained at a temperature of 300° C., 400° C., 500° C., and 600° C.

The X-ray diffraction patterns of each of the samples heated at 300° C., 400° C., 500° C. and 600° C. are given in FIGS. 7C, 7D, 7E, and 7F, and the results obtained by measuring Vicker's hardness (Hv) at room temperature are given in FIG. 6. The sample subjected to repeated forging processing as shown in FIG. 7B was found to comprise a super-saturated solid solution phase of aluminum containing a phase of pure aluminum and titanium as solid solution, and graphite particles finely dispersed therein. The hardness thereof was found to be Hv 122. By heating the sample to 500° C. to perform aging treatment, a non-equilibrium phase not identified in the equilibrium diagrams at room temperature was found to develop, and the hardness increased to Hv 210. The tensile strength at room temperature after repeated processing was found to be 30 kgf/mm$^2$, but it was found to be greatly improved to 85 kgf/mm$^2$ by performing aging treatment at 500° C.

Then, a bulk material containing 10% atomic % of graphite with respect to aluminum (Al-10at%C) was prepared in the same manner as in Example 1. The bulk material thus obtained and a bulk material obtained by adding 10 atomic % each of graphite and titanium with respect to aluminum prepared in Example 4 (Al-10at%C-10at%Ti), were compared with comparative materials, i.e., commercially available pure aluminum and Duralumin (A2024), in terms of elastic modulus and thermal expansion coefficient. With respect to the elastic modulus, samples of 1×2×1 mm$^3$ in size were prepared to from each material by cutting processing, and were measured by piezoelectric composite bar method. The thermal expansion coefficient was measured on the same samples at a heating rate of 5° C./min to obtain the average thermal expansion coefficient over a temperature range of from 50° to 200° C.

Figure 8:
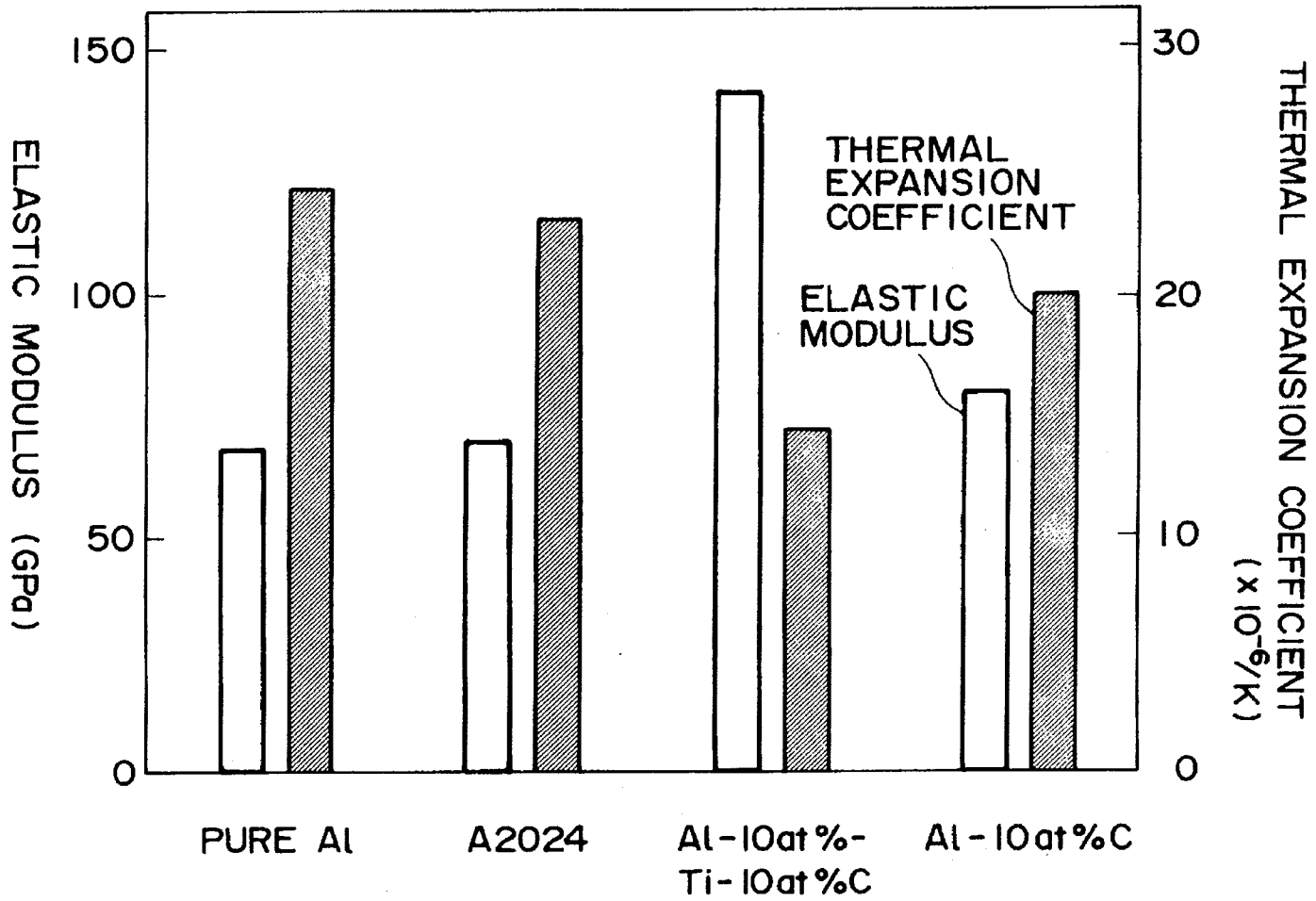
FIG. 8 is a graph which gives the elastic modulus and the thermal expansion coefficient for various types of aluminum materials in Example 4.

FIG. 8 shows the comparison of elastic modulus and thermal expansion coefficient of each sample. Pure aluminum and a high strength aluminum alloy known as Duralumin (A2024) yield well comparable results for elastic moduli, which are 70 GPa and 74 GPa, respectively, and for thermal expansion coefficient, which are $24.4\times10^{-6}$/K and $23.5\times10^{-6}$/K, respectively. However, Al-10at%C-10%Ti yields an elastic modulus of 138 GPa, a value twice as large as that of pure aluminum, and a thermal expansion coefficient of $14.7\times10^{-6}$/K, a value reduced to about 60% of that of pure aluminum. In case of Al-10at%C, the elastic modulus was found to be increased by about 10%, and the thermal expansion coefficient was found to be reduced by about 17% as compared with those of pure aluminum. Thus, the material in the form of bulk according to the present invention yields an elastic modulus equivalent to that of titanium and a thermal expansion coefficient equivalent to that of steel, which are far improved as compared with the conventional aluminum alloys. Thus, the aluminum alloy according to the present invention can be used in the parts of precision equipments and electric components such as a needle valve for use in fuel injection nozzles.

The elastic modulus and the thermal expansion coefficient of the other materials in the form of bulk according to the present invention were studied to obtain similar favorable results.

EXAMPLE 5

A sample of 15 mm in diameter and 25 mm in height was prepared by using a powder of the same composition as that used in Example 1. Then, a set of extrusion dies as shown in FIG. 3 was prepared. After applying graphite to the inner surface and the sliding portion of the die which is to be brought into contact with the sample, the sample was placed inside the extrusion dies, and was maintained at a temperature of 300° C. Upon reaching the predetermined temperature, a load of 18 ton was applied from one punch by using a hydraulic press, and the dies were turned upside down to apply a load from the other punch. The repeated compression processing was performed in this manner for 60 cycles.

The aluminum alloy thus obtained by extrusion was found to be completely consolidated, and was in the form of bulk free of cracks. Pure aluminum alone was identified by X-ray diffraction, and no graphite was observed. Thus, graphite is assumably present in the form of dispersed super-fine particle from 5 to 10 nm in average diameter.

EXAMPLE 6

A pure aluminum powder passed through a 350-mesh sieve, a pure graphite powder comprising particles about 1 μm in diameter, and a powder of pure iron passed through a 350-mesh sieve were mixed in the atomic ratio of 80:10:10, and after sufficiently mixing the mixed powder, the sample was subjected to repeated compression processing for 120 cycles in a set of dies whose temperature was set at 300° C. in the same manner as in Example 1 to obtain a powder compact of 2 mm in thickness. The dies were disintegrated, and the sample was thus taken out of the dies. A slight crack was found to generate on the surface of the thus obtained sample, but the powder particles were found to be tightly bonded to each other to provide a bulk material.

The sample was then subjected to X-ray diffraction analysis. One of the starting materials, graphite, was not identified on the X-ray diffraction pattern. From magnetic analysis, the content of pure iron was found to be low. Thus, it was found that the aluminum alloy of the sample consists of a structure mainly composed of an alloy containing iron in the form of solid solution and graphite dispersed therein as fine particles. The resulting alloy was heated at the temperatures 300° C., 400° C., 500° C., and 600° C. for an hour each to find fine crystals of aluminum compound ($Al_6Fe$) as a non-equilibrium phase and those of an equilibrium phase ($Al_3Fe$), thereby being precipitated from the alloy. The hardness of the alloy was found to increase to Hv 385 from the initial Hv 170 by heating as shown in FIG. 6. The same effect was observed in case silicon was used in the place of pure iron.

While the invention has been described in detail and with reference to specific embodiments thereof, it will be apparent to one skilled in the art that various changes and modifications can be made therein without departing from the spirit and scope thereof.

What is claimed is:

1. An aluminum alloy comprising:

an aluminum containing matrix; and carbon containing particles having an average particle size of 100 nm or less, said carbon containing particles being dispersed in said matrix in an amount of 1 to 40 atomic % with respect to the total atoms constituting the aluminum alloy, said aluminum alloy being in bulk form.

2. An aluminum alloy as claimed in claim 1, further comprising crystals of a super-saturated solid solution phase and/or a non-equilibrium phase having an average crystal size of 100 nm or less, said crystals being formed from a reaction between aluminum and at least one metal selected from the group consisting of elements of Groups 4a, 5a, 6a, 7a and 8a of the periodic table, dispersed in said matrix in an amount of 0.5 to 20 atomic % with respect to the total atoms constituting the aluminum alloy.

3. An aluminum alloy as claimed in claim 1, further comprising crystals of a super-saturated solid solution phase and/or a non-equilibrium phase having an average crystal size of 100 nm or less, said crystals being formed from a reaction between aluminum and at least one non-metal selected from the group consisting of silicon and boron, dispersed in said matrix in an amount of 0.5 to 20 atomic % with respect to the total atoms constituting the aluminum alloy.

4. An aluminum alloy as claimed in claim 1, wherein said carbon containing particles comprise crystals of a non-equilibrium phase and/or an equilibrium phase mainly composed of aluminum carbide and having an average crystal size of 100 nm or less.

5. An aluminum alloy as claimed in claim 4, further comprising crystals of a non-equilibrium phase and/or an equilibrium phase having an average crystal size of 100 nm or less, said crystals being formed from a reaction between aluminum and at least one metal selected from the group consisting of elements of Groups 4a, 5a, 6a, 7a and 8a of the periodic table, dispersed in said matrix in an amount of 0.5 to 20 atomic % with respect to the total atoms constituting the aluminum alloy.

6. An aluminum alloy as claimed in claim 4, further comprising crystals of a non-equilibrium phase and/or an equilibrium phase having an average crystal size of 100 nm or less, said crystals being formed from a reaction between aluminum and at least one non-metal selected from the group consisting of silicon and boron, dispersed in said matrix in an amount of 0.5 to 20 atomic % with respect to the total atoms constituting the aluminum alloy.

7. An aluminum alloy as claimed in claim 1, wherein said carbon containing particles comprise aluminum carbide.

8. An aluminum alloy as claimed in claim 1, wherein said aluminum containing matrix consists of an aluminum alloy.

9. An aluminum alloy as claimed in claim 1, wherein said carbon containing particles consist of graphite or amorphous carbon.

10. A process for producing an aluminum alloy, comprising the steps of:

preparing a raw material comprising aluminum and carbon as components; and forming an aluminum alloy in bulk form by inserting the raw material into a cavity formed by a set of dies and repeatedly applying plastic deformation to the raw material with the set of dies while maintaining the temperature of the raw material in the range of from 100° to 400° C., the resulting aluminum alloy comprising an aluminum containing matrix and carbon containing particles with an average particle size of 100 nm or less dispersed in the matrix.

11. A process for producing an aluminum alloy as claimed in claim 10, wherein said raw material in the preparing step further comprises at least one member selected from the group consisting of elements of Groups 4a, 5a, 6a, 7a and 8a of the periodic table, as components; and said resulting aluminum alloy in the forming step further comprises crystals of a super-saturated solid solution phase and/or a non-equilibrium phase with an average crystal size of 100 nm or less, said crystals being formed from said aluminum and said at least one member.

12. A process for producing an aluminum alloy as claimed in claim 10, wherein said raw material in the preparing step further comprises at least one non-metal selected from the group consisting of silicon and boron, as components; and said resulting aluminum alloy in the forming step further comprises crystals of a super-saturated solid solution phase and/or a non-equilibrium phase with an average crystal size of 100 nm or less, said crystals being formed from said aluminum and said at least one member.

13. A process for producing an aluminum alloy as claimed in claim 10, 11, or 12, wherein the preparing step is performed by compressing powders of said components or casting a melt of said components.

14. A process for producing an aluminum alloy as claimed in claim 10, 11 or 12, wherein said plastic deformation is applied to the raw material at a stress of 20 $kg/mm^2$ or higher.

15. A process for producing an aluminum alloy as claimed in claim 10, 11 or 12, wherein the set of dies comprises a plurality of trapezoidal punches disposed in the upper, lower, left and right positions to form a cavity surrounded by front portions thereof by contacting each of said punches on side walls thereof, and said forming step is performed by placing said raw material in the cavity and by compressing repeatedly the raw material in alternate directions between said upper and lower punches or said left and right punches in such a manner that punches not working stand free so as not to inhibit plastic deformation.

16. A process for producing an aluminum alloy as claimed in claim 10, 11, or 12, wherein the set of dies comprises a die having a cylinder therein and a pair of punches inserted into the cylinder, and said cavity is formed in the cylinder and has an orifice with a small cross sectional area, and the forming step is performed by placing the raw material in said cavity and by extruding said raw material through said orifice with one of the punches while the other of the punches moves in such a manner that the volume of the cavity is maintained constant.

17. A process for producing an aluminum alloy as claimed in claim 10, 11 or 12, further comprising a conversion step for forming a structure with a non-equilibrium phase and/or an equilibrium phase mainly composed of a compound with aluminum dispersed in said aluminum containing matrix by heat treating said resulting aluminum alloy in a temperature range of from 300° to 600° C.

18. A product comprising an aluminum containing matrix and carbon containing particles produced by a process comprising:

preparing a raw material comprising aluminum and carbon;

inserting the raw material into a cavity formed by a set of dies, and repeatedly applying plastic deformation to the raw material with the set of dies, while maintaining the temperature of the raw material in the range of from 100° to 400° C., resulting in an alloy comprising the aluminum containing matrix and the carbon containing particles dispersed in the matrix, the particles having an average size of 100 nm or less.

* * * * *